US005757175A

United States Patent [19]

Morishita et al.

[11] Patent Number: 5,757,175

[45] Date of Patent: May 26, 1998

[54] CONSTANT CURRENT GENERATING CIRCUIT

[75] Inventors: Fukashi Morishita; Masaki Tsukude; Tsukasa Ooishi; Kyoji Yamasaki, all of Hyogo, Japan

[73] Assignee: Mitsubishi Denki Kabushiki Kaisha, Tokyo, Japan

[21] Appl. No.: 782,036

[22] Filed: Jan. 13, 1997

[30] Foreign Application Priority Data

Aug. 6, 1996 [JP] Japan ..... 8-206893

[51] Int. Cl.[6] ..... G05F 3/16

[52] U.S. Cl. ..... 323/315; 323/317; 323/312

[58] Field of Search ..... 323/315, 314, 323/317, 312

[56] References Cited

U.S. PATENT DOCUMENTS 4,901,002 2/1990 Simon ..... 323/312
5,180,976 1/1993 Yamazaki ..... 323/315
5,448,159 9/1995 Kojima et al. ..... 323/315

FOREIGN PATENT DOCUMENTS 61-294913 12/1986 Japan .
3-48506 3/1991 Japan .

*Primary Examiner*—Edward Tso
*Assistant Examiner*—Shawn Riley
*Attorney, Agent, or Firm*—McDermott, Will & Emery

[57] ABSTRACT

A current source is provided between a first p channel MOS transistor and a ground node, and a current/voltage converting element is provided isolatedly from the current source between the ground node and a second p channel MOS transistor having a conductance coefficient sufficiently larger than that of the first MOS transistor. The second MOS transistor is connected through a resistive element to an external power supply node. A voltage produced by the current/voltage converting element is converted into current by a voltage/current converting portion. Thus, constant current free from both vibration and a deadlock phenomenon and with small external power supply voltage dependency is supplied.

20 Claims, 9 Drawing Sheets

CONSTANT CURRENT GENERATING CIRCUIT

BACKGROUND OF THE INVENTION

1. Field of the Invention

The present invention relates to a constant current generating circuit, and particularly to a constant current generating circuit for use in an internal power supply down-converter for down-converting an external power supply voltage to produce an internal power supply voltage. More particularly, the present invention relates to a circuit for generating constant current used to generate a reference voltage for determination of an internal power supply voltage level in the internal power supply down-converter.

2. Description of the Background Art

Reduction in operating power supply voltage is effective for reducing power consumption in semiconductor devices or the like. Reduction in operating power supply voltage decreases charge/discharge current of load capacitance (internal interconnection) by the amount of the reduction in operating power supply voltage. Accordingly, since power consumption P is defined by the product of current I and power supply voltage V (i.e. P=I·V), reduction in power supply voltage lowers both current and voltage, whereby power consumption is reduced in proportion to the square of the reduction rate of operating power supply voltage.

General-purpose memories such as widely used DRAMs (Dynamic Random Access Memories) have an internal structure as follows. An MOS transistor (insulated gate type field effect transistor) constituting an internal circuit has a gate length (channel length) scaled down close to the limit of refinement in each generation, reducing occupying area of the MOS transistor. On the other hand, an externally supplied power voltage is down-converted internally by means of an on-chip down-converter to make an internal circuit of a general-purpose memory operate with this internal down-converted power supply voltage. Thus, a power supply voltage of an external general-purpose LSI (Large Scale Integrated circuit) and an external power supply voltage of a general-purpose memory are kept equal to each other to constitute a system with a single power supply and to maintain compatability with general-purpose memories in the previous generation. The use of this internal down-converted power supply voltage assures breakdown voltage characteristics of a scaled-down MOS transistor, achieving both improved reliability and reduced power consumption.

This internal power supply down-converting method further has the following features. More specifically, if a down-converted power supply voltage is set to a fixed value which is sufficiently lower than an external power supply voltage, it is not affected by variation in the external power supply voltage, if any, to be held stably at a fixed level, and a gate potential of an MOS transistor constituting an internal circuit is not varied, whereby an operation speed of the internal circuit is stabilized regardless of the external power supply voltage. Furthermore, when this internal power supply voltage has positive temperature characteristics, increase in temperature might reduce an operation speed of the constituent MOS transistor, but it increases the internal power supply voltage and accordingly an H level potential applied to the gate of the MOS transistor, whereby current driving capability of the MOS transistor increases, resulting in suppression of reduction in operation speed due to the temperature rising.

FIG. 17 schematically shows the structure of a conventional internal power supply down-converter. In FIG. 17, the internal power supply down-converter includes a reference voltage generating circuit VRG operating with an external power supply voltage EXVcc and a ground voltage Vss as both operating power supply voltages for generating a reference voltage Vref, a comparator CMP operating with the external power supply voltage EXVcc and the ground voltage Vss as both operating power supply voltages for comparing the reference voltage Vref with an internal power supply voltage INVcc on an internal power supply line PSL, a driver transistor DT constituted by a p channel MOS transistor responsive to an output signal of comparator CMP for supplying current from an external power supply node EXVcc (a power supply node and a voltage applied thereto are herein denoted with the same reference character) to internal power supply line PSL.

Reference voltage generating circuit VRG, of which internal structure will be described later in detail, generates the reference voltage Vref independent of the external power supply voltage EXVcc when the voltage EXVcc is at least at a prescribed voltage level.

Comparator CMP reduces its output signal level if the internal power supply voltage INVcc is lower than the reference voltage Vref, while it outputs a signal at an H level when the internal power supply voltage INVcc is higher than the reference voltage Vref. Driver transistor DT has its conductance increased with reduction in potential level of the output signal of comparator CMP, to supply large current. Meanwhile, the driver transistor DT has its conductance reduced with the internal power supply voltage INVcc being higher than the reference voltage Vref, to stop current supply onto internal power supply line PSL. This internal power supply down-converter therefore maintains the internal power supply voltage INVcc at the reference voltage Vref level. An internal circuit INC operates with the internal power supply voltage INVcc on internal power supply line PSL as one operating power supply voltage.

FIG. 18 shows one example of the structure of comparator CMP shown in FIG. 17. In FIG. 18, comparator CMP includes p channel MOS transistors TPa and TPb receiving current from an external power supply node EXVcc and constituting a current mirror stage, n channel MOS transistors TNa and TNb receiving current from MOS transistors TPa and TPb and constituting a comparing stage for comparing the internal power supply voltage INVcc with the reference voltage Vref, and an n channel MOS transistor T connected between a ground node Vss and each respective one conduction node of MOS transistors TNa and TNb and serving as a current source.

The gate and one conduction node of MOS transistor TPb are connected to another conduction node of MOS transistor TNb. A signal to be applied to the gate of driver transistor DT is output from a connection node NO between MOS transistors TPa and TNa. MOS transistors TNa and TNb respectively receive the reference voltage Vref and the internal power supply voltage INVcc at their gates. MOS transistor T receives an activation signal ACT at its gate and is rendered conductive upon operation of the internal circuit to activate comparator CMP. When the activation signal ACT is at an L level, MOS transistor T is off and a current path from external power supply node EXVcc to ground node Vss in comparator CMP is cut off, whereby a signal level from output node NO attains an H level of the external power supply voltage EXVcc level.

When the reference voltage Vref is higher than the internal power supply voltage INVcc, conductance of MOS transistor TNa becomes greater than that of MOS transistor TNb, whereby current flowing through MOS transistor TNa becomes larger than that flowing through MOS transistor TNb. The current for MOS transistors TNa and TNb is applied through MOS transistors TPa and TPb, respectively. MOS transistors TPa and TPb constitute a current mirror circuit and MOS transistor TPb constitutes a master stage. When MOS transistors TPa and TPb have the same size (conductance coefficient β), current of the same magnitude flows through MOS transistors TPa and TPb. Accordingly, current of the same magnitude as that of current flowing through MOS transistor TNb is supplied from MOS transistor TPa to MOS transistor TNa, whereby a potential level at output node NO is lowered.

Meanwhile, when the internal power supply voltage INVcc is higher than the reference voltage Vref, the amount of current flowing through MOS transistor TNb becomes larger than that of current flowing through MOS transistor TNa, and current of the same magnitude as that of current flowing through MOS transistor TNb is applied through MOS transistor TPa to MOS transistor TNa. As a result, the potential level at output node NO is raised.

As shown in FIG. 18, comparator CMP is comprised of a differential amplifier for amplifying the difference between the reference voltage Vref and the internal power supply voltage INVcc. Thus, current according to the difference between the internal power supply voltage INVcc and the reference voltage Vref can be supplied from external power supply node EXVcc through driver transistor DT to internal power supply line PSL, whereby the internal power supply voltage INVcc can be retained stably at a fixed level.

FIG. 19 shows the structure of the reference voltage generating circuit shown in FIG. 17. In FIG. 19, reference voltage generating circuit VRG includes a constant current generating circuit CCG operating with the external power supply voltage EXVcc and the ground voltage Vss as both operating power supply voltages for producing constant current I independent of the external power supply voltage EXVcc, a current/voltage converting circuit CVC for converting current I from constant current generating circuit CCG into voltage to produce the reference voltage Vref, and a start-up circuit STC for activating the constant current generating operation of constant current generating circuit CCG when the external power supply voltage EXVcc attains a prescribed potential level.

Constant current generating circuit CCG includes a p channel MOS transistor TP1 connected between external power supply node EXVcc and an internal node NA and having its gate connected to an internal node NB, a resistive element R having its one end connected to external power supply node EXVcc, a p channel MOS transistor TP2 connected between resistive element R and an internal node ND and having its gate connected to internal node NB, an n channel MOS transistor TN1 connected between internal node NA and ground node Vss and having its gate connected through an internal node NC to an internal node ND, and an n channel MOS transistor TN2 connected between internal node ND and ground node Vss and having its gate connected to internal nodes NC and ND. The ratio of gate width to gate length (the ratio of channel width to channel length) W/L or the conductance coefficient β of p channel MOS transistor TP2 is made about ten times that of p channel MOS transistor TP1. MOS transistors TN1 and TN2 have approximately the same size the same ratio of gate width to gate length).

Constant current generating circuit CCG further includes an n channel MOS transistor TN3 connected between an internal node NE and the ground node and having its gate connected to internal node NC, a p channel MOS transistor TP3 connected between external power supply node EXVcc and internal node NE and having its gate connected to internal node NE, and a p channel MOS transistor TP4 connected between external power supply node EXVcc and a current output node NF and having its gate connected to the gate of MOS transistor TP3. MOS transistors TP3 and TP4 constitute a current mirror circuit and have the same size.

Current/voltage converting circuit CVC includes p channel MOS transistors PRa . . . PRb and PRc connected in series between current output node NF and the ground node, and fuse elements La . . . Lb connected in parallel with respective MOS transistors PRa . . . PRb. MOS transistors PRa . . . PRb and PRc have their respective backgates (substrate regions) connected to current output node NF and their respective gates connected to the ground node.

Start-up circuit STC includes a p channel MOS transistor TP5 connected between external power supply node EXVcc and an internal node NG and having its gate connected to the ground node, an n channel MOS transistor TN4 connected between internal node NA and the ground node and having its gate connected to internal node NG, and an n channel MOS transistor TN5 connected between internal node NG and the ground node and having its gate connected to internal node NC. MOS transistor TP5 has a large channel length and functions as a load resistive element (with a small conductance coefficient β and a current limiting function). Now, the operation of each circuit will be described.

When the external power supply voltage EXVcc is applied and a potential thereof rises, current flows in start-up circuit STC through MOS transistor TP5, whereby a potential at node NG rises. MOS transistor TN4 is turned on by this potential rise at internal node NG to suppress potential rise at internal node NB of constant current generating circuit CCG. Since the potential rise at internal node NB is suppressed, MOS transistors TP1 and TP2 are turned on with potential rise of the external power supply voltage EXVcc, whereby current is supplied through resistive element R and MOS transistor TP2 to internal node ND, causing potential rise at internal node ND. When a potential at internal node ND is equal to or higher than the threshold voltage of MOS transistor TN2, MOS transistor TN2 is turned on, whereby current flows from external power supply node EXVcc into ground node Vss, causing operation of constant current generating circuit CCG.

Internal node NC is connected to the gate of MOS transistor TN5 of start-up circuit STC, MOS transistors TN2 and TN5 constitute a current mirror circuit, and MOS transistors TN2 and TN1 also constitute a current mirror circuit. In this condition, therefore, current of the same magnitude flows in MOS transistors TN1 and TN5 (assuming that MOS transistors TN1 and TN5 have the same size), whereby respective potentials at internal nodes NG and NA become equal to each other, turning MOS transistor TN4 off. Thus, discharge of internal node NB through MOS transistor TN4 is stopped, and constant current generating circuit CCG starts the constant current generating operation.

More specifically, start-up circuit STC stops the constant current generating operation as well as suppresses potential rise at internal node NB when the external power supply voltage EXVcc is unstable upon application thereof, and stops that operation when the constant current generating operation becomes possible by potential rise at internal node ND with increase in external power supply voltage EXVcc after application thereof.

In addition, this start-up circuit STC has a function to prevent a so-called "deadlock phenomenon" that the constant current generating operation in constant current generating circuit CCG is stopped with turning-off of MOS transistors TN1 and TN2 by reduction in potential at internal node ND to a value equal to or lower than the threshold voltage of MOS transistor TN2 for some reasons and with turning-off of MOS transistors TP1 and TP2 by potential rise at node NA being charged by MOS transistor TP1. More specifically, when a potential at node ND falls extremely and MOS transistors TN1 and TN2 are off, MOS transistor TN5 is turned off causing increase in potential at internal node NG to turn on MOS transistor TN4 in start-up circuit STC, whereby potential rise at internal node NB is suppressed, preventing both MOS transistors TP1 and TP2 from being turned off.

In constant current generating circuit CCG, the conductance coefficient or the ratio of gate width to gate length of MOS transistor TP2 is set to a value of ten times that of MOS transistor TP1. Therefore, current of magnitude which is ten times that flowing through MOS transistor TP1 should flow through MOS transistor TP2. However, resistive element R causes voltage drop, and a source potential of MOS transistor TP2 becomes lower than the external power supply voltage EXVcc, whereby the amount of current flowing through MOS transistor TP2 is limited. This current for MOS transistor TP2 is suppressed. This current for MOS transistor TP2 is supplied to MOS transistor TN2. Mirror current of this current flowing through MOS transistor TN2 flows through MOS transistor TN1. MOS transistors TN1 and TN2 have the same size (the same ratio of gate width to gate length) and therefore current of the same magnitude flows therethrough. Current flowing through MOS transistor TN1 is supplied from MOS transistor TP1. Accordingly, current flowing through MOS transistor TP2 is equal to that flowing through MOS transistor TP1.

When the external power supply voltage EXVcc becomes higher, the potential difference between the gate and the source of MOS transistor TP1 is enlarged and current flowing through MOS transistor TP1 is increased. At this time, current flowing through MOS transistor TP2 is also increased and a source potential of MOS transistor TP2 is lowered, resulting in suppression against the increase in current amount. Therefore, even if the external power supply voltage EXVcc is increased in level, current flowing through MOS transistors TP1 and TP2 is constant.

On the contrary, when the external power supply voltage Vcc becomes lower, the potential difference between the gate and the source of MOS transistor TP1 is reduced and the amount of current flowing through MOS transistor TP1 is decreased. At this time, current flowing through MOS transistor TP2 is reduced in amount and a source potential of MOS transistor TP2 is accordingly increased (the amount of voltage drop at resistive element R is reduced), resulting in a constant amount of current. Consequently, constant current is achieved by a feedback loop formed of MOS transistors TP1, TP2, TN1 and TN2, regardless of the external power supply voltage EXVcc level.

MOS transistor TN3 constitutes a current mirror circuit together with MOS transistor TN2, and mirror current of current flowing through MOS transistor TN2 flows through MOS transistor TN3. Current is supplied through MOS transistor TP3 to MOS transistor TN3, and current of the same magnitude as that flowing through MOS transistor TN3 flows into MOS transistor TP3. MOS transistors TP3 and TP4 constitute a current mirror circuit and therefore mirror current I is output from MOS transistor TP4. This current I is constant current independent of the external power supply voltage EXVcc, as described previously.

If the combined resistance of p channel MOS transistors PRa . . . PRb and PRc functioning as resistive elements each having inherent channel resistance is indicated by Rc, current/voltage converting circuit CVC produces a reference voltage Vref as defined by the following equation.

$$Vref=I\cdot Rc$$

The resistance value Rc is optimally set by programming (selective blowing) of fuse elements La . . . Lb.

Therefore, since current I is independent of the external power supply voltage EXVcc, this reference voltage Vref will be a constant voltage independent of the external power supply voltage EXVcc (but within the range of the external power supply voltage in which constant current generating circuit CGC operates stably).

In the structure of constant current generating circuit CCG shown in FIG. 19, current flowing through MOS transistors TP1 and TN1 is made equal in magnitude to that flowing through MOS transistors TP2 and TN2. The respective conductance coefficient β (or ratios of gate width to gate length) of MOS transistors TP1 and TP2 are set to have the ratio of 1:10. Thus, the difference in source potential between MOS transistors TP1 and TP2 which is produced when current of the same magnitude flows into MOS transistors TP1 and TP2 is converted into current by resistive element R. This current is transmitted to the current/voltage converting portion CVC as well as fedback to a path of MOS transistors TP1 and TN1. With the feedback effect, the portion constituted by MOS transistors TP1, TP2, TN1 and TN2 can transmit optimal constant current to the current/voltage converting portion while monitoring the state of output current.

Due to the presence of feedback loop in constant current generating circuit CCG, however, if noise having a vibration frequency close to a characteristic frequency of the feedback system is introduced from an external power supply voltage supply line, for example, the feedback system amplifies the noise to cause oscillation in the feedback loop, whereby output current I might be varied.

Furthermore, when a potential at internal node NC (or internal node ND) falls extremely to a level close to the ground potential Vss level, MOS transistors TN1 and TN2 are turned off, preventing current from flowing through MOS transistors TN1 and TN2. In this case, a potential at internal node NA (internal node NB) rises according to current supplied from MOS transistor TP1 and MOS transistors TP1 and TP2 are turned off, whereby the deadlock phenomenon that no current flows in this circuit portion might occur. Start-up circuit STC is thus essential for prevention of such a "deadlock" phenomenon. Furthermore, insertion of a low pass filter in the feedback loop or other measures for prevention of noise introduction into external power supply node EXVcc are required in order to prevent oscillation of the feedback loop resulting from noise or the like.

Since provision of such a start-up circuit is necessary, layout area of the reference voltage generating circuit is increased. In addition, if a low pass filter is provided in the feedback loop, layout area of reference current generating circuit CCG is increased by large capacitance and resistance required for the low pass filter.

The reference voltage Vref has positive temperature characteristics. Current I is determined by a resistance value of resistive element R, and current I is reduced with increase in the resistance value of resistive element R with temperature.

Meanwhile, each channel resistance of MOS transistors PRa . . . PRb and PRc included in current/voltage converting circuit CVC has a positive temperature coefficient, and the channel resistance value increases with increase in temperature. Accordingly, current I and the resistance value Rc of current/voltage converting circuit CVC exert effects in opposite directions with respect to temperature, degrading temperature dependent characteristics of channel resistance of current/voltage converting circuit CVC, resulting in slightly positive temperature characteristics.

The reference voltage Vref is optimally set by programming (selective blowing) of fuse elements La . . . Lb of current/voltage converting portion CVC. Each of MOS transistors PRa . . . PRb has different channel resistance, and after manufacture of a semiconductor device, the reference voltage Vref is monitored and an appropriate fuse element is blown so that the reference voltage Vref has an optimal value. The respective backgates of MOS transistors PRa . . . PRb are coupled in common to receive the reference voltage Vref. Accordingly, each of MOS transistors PRa . . . PRb has a different potential difference between the source and the backgate and also has a different backgate bias effect, whereby each of MOS transistors PRa . . . PRb has different channel resistance, resulting in difficulty in trimming of the reference voltage Vref.

SUMMARY OF THE INVENTION

It is an object of the present invention to provide a constant current generating circuit capable of stably supplying constant current with small occupying area.

It is another object of the present invention to provide a constant current generating circuit capable of readily and stably generating a reference voltage at a desired voltage level.

A constant current generating circuit according to the present invention includes a first field effect transistor of a first conductivity type connected between a node receiving a first power supply voltage and a first internal node and having its control electrode node connected to the first internal node, a resistive element connected between the node receiving the first power supply voltage and a second internal node, a second field effect transistor of a first conductivity type connected between the second internal node and a third internal node and having its control electrode node connected to the control electrode node of the first field effect transistor, a current source coupled between the first internal node and a node receiving a second power supply voltage for applying constant current, a current/voltage converting element provided separately from the current source between the third internal node and the node receiving the second power supply voltage for producing at the third internal node a voltage according to current flowing in the second field effect transistor, and voltage/current converting circuit for further converting the voltage produced by the current/voltage converting element into current for output.

The current source is connected between the first field effect transistor and the second power supply voltage node and the voltage/current converting circuit is provided separately from the current source between the second field effect transistor and the second power supply voltage supply node, whereby a feedback loop is formed only in the first and second field effect transistors and a so-called "open loop" is formed without feedback loop, preventing a vibration operation resulting from noise. In addition, since the current source is provided, the current source and the current/voltage converting element will never be turned off simultaneously, whereby a so-called "deadlock" phenomenon is prevented. Furthermore, no start-up circuit is for prevention of this "deadlock" is required, achieving a circuit with small occupying area.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Basic Structure]

Figure 1:
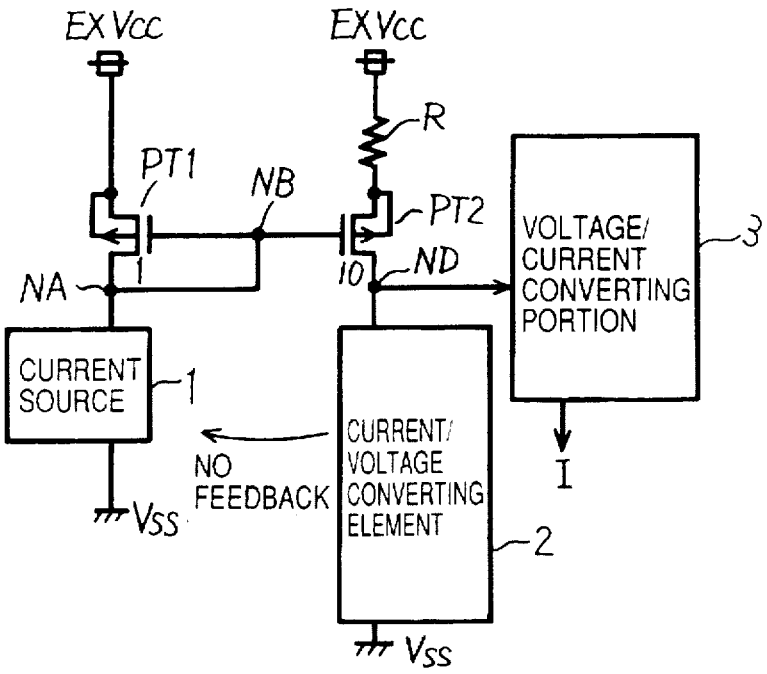
FIG. 1 shows the basic structure of a constant current generating circuit according to the present invention.

FIG. 1 shows the basic structure of a constant current generating circuit of the present invention. In FIG. 1, the constant current generating circuit includes a p channel MOS transistor PT1 connected between an external power supply node EXVcc and an internal node NA and having its gate connected to internal nodes NA and NB, a current source 1 connected between internal node NA and a ground node Vss, a resistive element R having its one end connected to external power supply node EXVcc, a p channel MOS transistor PT2 connected between resistive element R and an internal node ND and having its gate connected to internal nodes NA and NB, a current/voltage converting element 2 for producing at internal node ND a voltage according to current flowing through MOS transistor PT2, and a voltage/current converting portion 3 for producing current I according to the voltage generated at internal node ND for output.

The ratio of gate width (channel width) W to gate length (channel length) L of MOS transistor PT1 is set to about one tenth of that of MOS transistor PT2. In other words, the conductance coefficient β of MOS transistor PT2 is set to about 10 (ten) times that of MOS transistor PT1, and current driving capability of MOS transistor PT2 is made larger than that of MOS transistor PT1.

Current source 1 causes constant current flow in MOS transistor PT1. When current flows in MOS transistor PT1, a gate potential of MOS transistor PT2 is adjusted through nodes NA and NB, and current according to the potential difference between internal node NB and the source of MOS transistor PT2 flows in MOS transistor PT2. The source potential of MOS transistor PT2 falls with increase in the current flowing through MOS transistor PT2, while rising with reduction in the current flowing through MOS transistor PT2. More specifically, a potential according to the difference in conductance coefficient between MOS transistors PT1 and PT2 appears at the source of MOS transistor PT2, and this source potential is converted into current at resistive element R. Accordingly, as in the conventional example, stable current I having small dependency on external power supply voltage EXVcc is produced through MOS transistor PT2.

Current/voltage converting element 2 converts the current flowing through MOS transistor PT2 into voltage, and voltage/current converting portion 3 again converts the voltage produced by current/voltage converting element 2 into current and outputs constant current I.

Current source 1 and current/voltage converting element 2 are separated from each other. Therefore, in the constant current generating circuit shown in FIG. 1, only a potential at internal node NA is fedback to the gates of MOS transistors PT1 and PT2, that is, to internal node NB without formation of feedback loop, whereby prevention of oscillation or vibration is ensured. Furthermore, since current source 1 and current/voltage converting element 2 are separated from each other, they will never be simultaneously turned off, whereby prevention of "a deadlock phenomenon" can be assured. Moreover, no start-up circuit for prevention of "the deadlock phenomenon" is required, achieving reduction in circuit occupying area. In addition, since no feedback loop is present, no low pass filter for prevention of an oscillation phenomenon is required in the constant current generating circuit, achieving reduction in circuit occupying area. Now, each specific embodiment will be described.

[First Embodiment]

Figure 2:
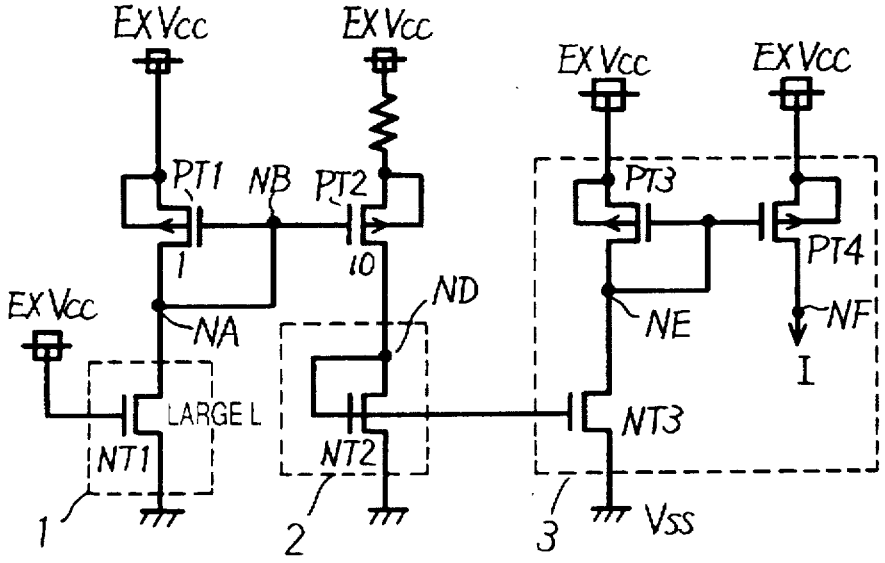
FIG. 2 shows the structure of a constant current generating circuit according to a first embodiment of the present invention.

FIG. 2 shows the structure of a constant current generating circuit according to a first embodiment of the present invention. In FIG. 2, a current source 1 is constituted by an n channel MOS transistor NT1 connected between an internal node NA and a ground node Vss and having its gate connected to receive an external power supply voltage EXVcc. This MOS transistor NT1 has a large gate length L and functions as a resistive element, and further, is rendered conductive with the external power supply voltage EXVcc being equal to or higher than the threshold voltage Vthn thereof to supply current all the time.

Current/voltage converting element 2 includes an n channel MOS transistor NT2 connected between an internal node ND and ground node Vss and having its gate and drain connected to each other. This current/voltage converting element 2 has a conductance coefficient smaller than that of MOS transistor PT2, and generates at node ND a voltage according to current supplied through MOS transistor PT2.

A voltage/current converting portion 3 includes an n channel MOS transistor NT3 connected between an internal node NE and ground node Vss and having its gate connected to internal node ND, a p channel MOS transistor PT3 connected between external power supply node EXVcc and internal node NE and having its gate connected to internal node NE, and a p channel MOS transistor PT4 connected to MOS transistor PT3 in a current mirror manner for supplying current from external power supply node EXVcc to an output node NF.

Figure 19:
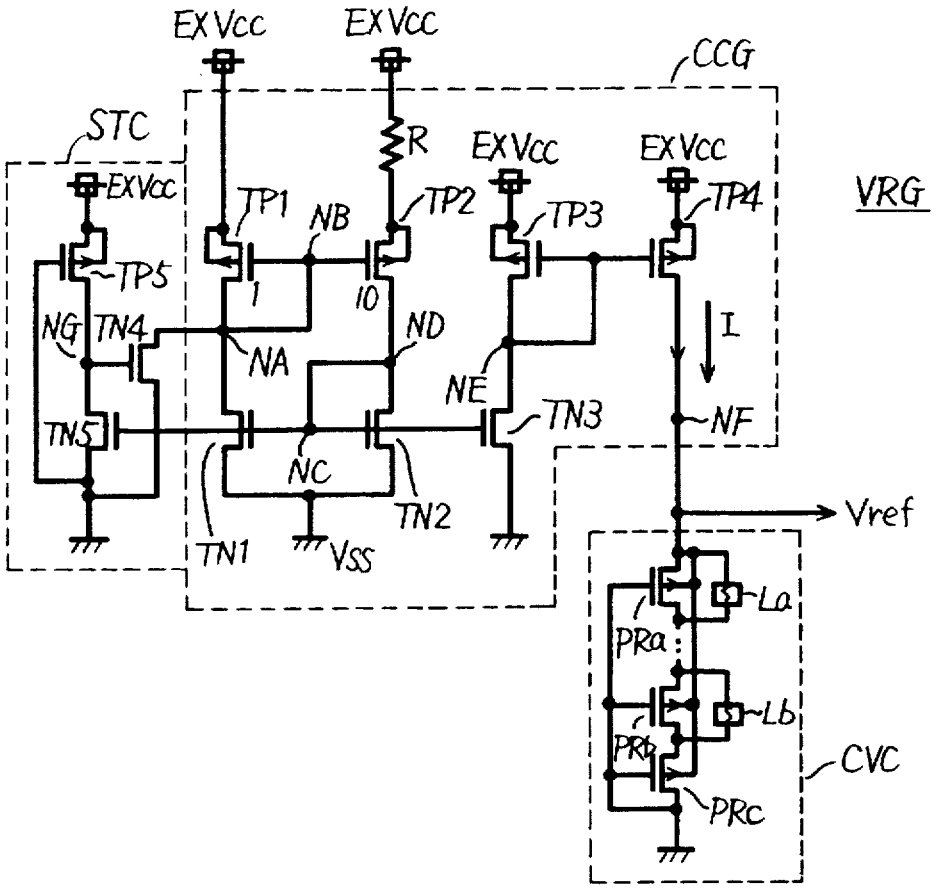
FIG. 19 PRIOR ART
FIG. 19 shows the structure of a reference voltage generating circuit shown in FIG. 17.

This voltage/current converting portion 3 has substantially the same structure as that of a constant current output stage included in constant current generating circuit CCG shown in FIG. 19. MOS transistor NT3 receives a potential at node ND at its gate and produces mirror current of current flowing in MOS transistor NT2. This current flowing through MOS transistor NT3 has the magnitude determined by the potential at node ND, and the voltage at node ND is converted into current by MOS transistor NT3. MOS transistor PT3 supplies the current flowing through MOS transistor NT3, and mirror current of the current flowing through MOS transistor PT3 flows through MOS transistor PT4 to be output from output node NF.

In the structure of the constant current generating circuit shown in FIG. 2, the respective gates of MOS transistors NT1 and NT2 are separated from each other, resulting in the structure of an "open loop type" constant current generating circuit.

Current flowing through MOS transistor NT1 has the magnitude determined by a voltage level of the external power supply voltage EXVcc. With increase in temperature, channel resistance of MOS transistor NT1 is increased to reduce current flowing therethrough. In this case, current flowing through MOS transistor PT2 is also reduced (a gate/drain voltage of MOS transistor PT1 is being applied to the gate of MOS transistor PT2). With increase in temperature, however, a resistance value of resistive element R is increased to suppress reduction in source potential of MOS transistor PT2. If resistive element R is formed of polysilicon resistance or diffusion resistance, temperature dependency of resistive element R is larger than that of channel resistance of MOS transistor NT1. Accordingly, upon increase in temperature as well, temperature dependency characteristics of the channel resistance of MOS transistor NT1 is compensated for, and current flowing through MOS transistor PT2 has negative temperature dependency characteristics. A potential at node ND is determined by current flowing through MOS transistor PT2, and therefore, current I output from voltage/current converting portion 3 also has negative temperature dependency characteristics. This current I is converted into voltage by means of such MOS transistors as shown in FIG. 19, whereby a reference voltage Vref having less positive temperature dependency characteristics can be produced.

In addition, with the use of MOS transistors PT1 and PT2, the external power supply voltage EXVcc dependency of current flowing through MOS transistor NT1 can be reduced as well as the external power supply voltage EXVcc dependency of current flowing through MOS transistor PT2 can also be reduced. Thus, a reference potential generating circuit is implemented maintaining basic characteristics of the conventional feedback loop type reference potential generating circuit, that is, maintaining small external power supply voltage dependency and the positive temperature characteristics.

Furthermore, MOS transistor NT1 is rendered conductive when applied external power supply voltage EXVcc attains a voltage level higher than the threshold voltage thereof to supply current all the time, whereby the possibility of occurrence of the "deadlock" phenomenon is reduced significantly. Moreover, since the respective gates of MOS transistors NT1 and NT2 are separated from each other, no feedback loop exists, reducing oscillation resulting from noise or the like. Now, the external power supply voltage dependency of current flowing through MOS transistor PT2 will be described.

Figure 3:
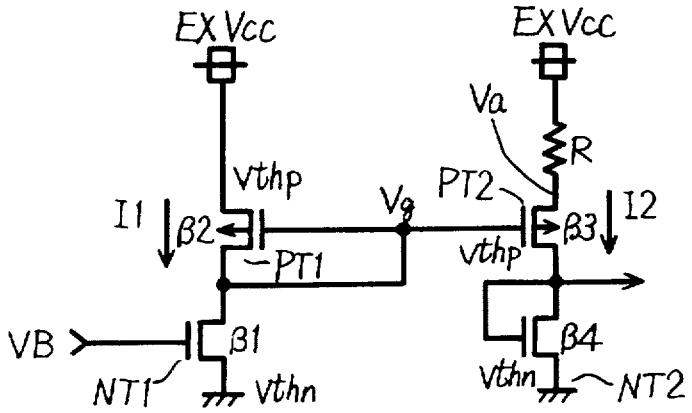
FIG. 3 is a diagram for use in illustration of the operation of the constant current generating circuit shown in FIG. 2.

As shown in FIG. 3, the threshold voltage of MOS transistors PT1 and PT2 is herein denoted by Vthp, and the threshold voltage of MOS transistors NT1 and NT2 by Vthn. In addition, respective conductance coefficients of MOS transistors NT1, PT1, PT2 and NT2 are herein denoted by β1, β2, β3 and β4. A gate potential of MOS transistors PT1 and PT2 is herein denoted by Vg.

Since MOS transistor NT1 produces current I1 according to a gate voltage VB thereof, the following equation (1) is obtained.

$$I1=\beta 1\cdot(VB-Vthn)^2 \quad (1)$$

Furthermore, since this current I1 flows through MOS transistor PT1, the following equation (2) is obtained.

$$I1=\beta 2\cdot(EXVcc-Vg-Vthp)^2 \quad (2)$$

Meanwhile, since current I2 is applied by MOS transistor PT2, the following equation is obtained, wherein a source voltage of MOS transistor PT2 is denoted by Va.

$$I2=\beta 3\cdot(VA-Vg-Vthp)^2=\beta 3\cdot(EXVcc-I2\cdot R-Vg-Vthp)^2 \quad (3)$$

The following equation (4) is obtained from the above equations (1) and (2).

$$\sqrt{\beta 1}\cdot(VB-Vthn)=\sqrt{\beta 2}\cdot(EXVcc-Vg-Vthp) \quad (4)$$

$$\therefore EXV-Vg-Vthp=\sqrt{\beta 1/\beta 2}\cdot(VB-Vthn)$$

When this equation (4) is substituted in the above equation (3), the following equation (5) is obtained.

$$I2=\beta 3\cdot\{\sqrt{\beta 1/\beta 2}\cdot(VB-Vthn)-I2\cdot R\}^2 \quad (5)$$

When this equation (5) is rearranged for I2, the following equation is obtained.

$$\therefore I2=\frac{2\cdot\beta 3\cdot R\sqrt{\beta 1/\beta 2}\cdot X+1\pm\sqrt{4\cdot\beta 3\cdot R\sqrt{\beta 1/\beta 2}\cdot X+1}}{2\cdot\beta 3\cdot R^2}; \quad (6)$$

$$X=VB-Vthn$$

Assuming that the conductance coefficients β1 and β2 are $10^{-6}$ A/V, the conductance coefficient of MOS transistor PT2 is $10^{-5}$ A/V which is ten times the conductance coefficients β1 and β2. In addition, assuming that a resistance value of resistive element R is 2.5KΩ, the following equation is obtained.

$$I2=\frac{2\cdot 10^{-5}\cdot 2.5\cdot 10^3X+1\pm\sqrt{4\cdot 10^{-5}\cdot 2.5\cdot 10^3X+1}}{1.25\times 10^6}=\frac{0.05X+1\pm\sqrt{0.1X+1}}{1.25\times 10^6}$$

In the above equation, current I2 has a positive value and therefore a negative sign in the double sign is not used. The difference X between the external power supply voltage EXVcc and the threshold voltage Vthn is about 2 (when the external power supply voltage EXVcc is 3.3 V). Accordingly, the following approximation of current I2 can be made from the above equation.

$$I2\sim(2+0.1\ X)/1.25\cdot 10^6$$

Accordingly, current I2 is retained at an approximately constant value even with slight variation in value of X. Thus, current I2 with extremely small external power supply voltage EXVcc dependency is produced. A gate potential of MOS transistor NT2 is determined according to this current I2, and constant current I having extremely small external power supply voltage EXVcc dependency is supplied from voltage/current converting portion 3 according to a gate/drain potential of MOS transistor NT2.

In addition, as can be seen from the above equation (6), current I2 is reduced with increase in resistance value of resistive element R. Therefore, if the resistance value of resistive element R is increased with rise in temperature, current I2 is reduced to compensate for the positive temperature characteristics of channel resistance of the MOS transistors in the reference voltage generating portion, achieving small positive temperature dependency characteristics required for the reference voltage Vref.

As described above, according to the first embodiment, an n channel MOS transistor receiving the external power supply voltage EXVcc is used in the current source, whereby constant current can be generated by immediate current supplying with increase in external power supply voltage EXVcc at the time of application thereof.

[Second Embodiment]

Figure 4:
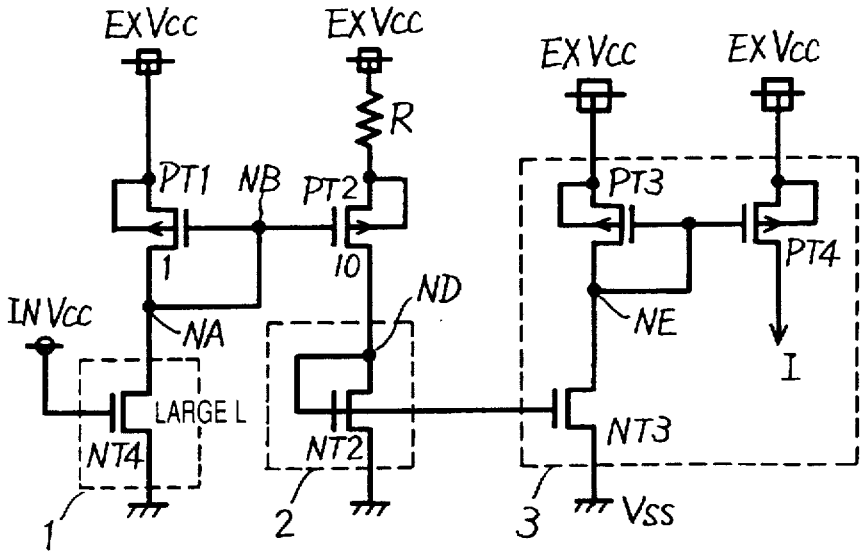
FIG. 4 shows the structure of a constant current generating circuit according to a second embodiment of the present invention.

FIG. 4 shows the structure of a constant current generating circuit according to a second embodiment of the present invention. In the constant current generating circuit shown in FIG. 4, a current source 1 includes an n channel MOS transistor NT4 connected between an internal node NA and a ground node Vss and having its gate connected to receive an internal power supply voltage INVcc. The structure of the constant current generating circuit is the same as that shown in FIG. 2 except for the current source 1, and therefore, corresponding portions are denoted by the same reference numerals or characters. MOS transistor NT4 has an increased channel length, and functions as a constant current source for supplying constant current according to the internal power supply voltage INVcc.

Figure 5:
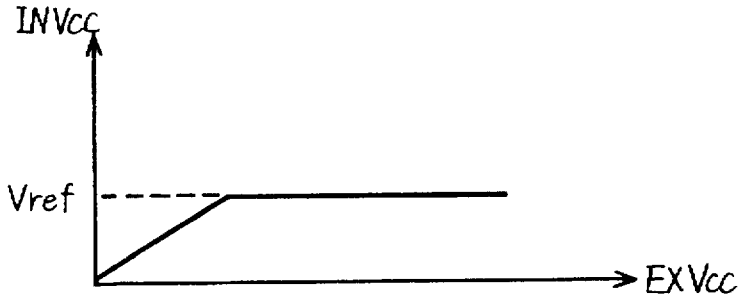
FIG. 5 is a diagram showing the relationship between internal power supply voltage and external power supply voltage.

As shown in FIG. 5, with an external power supply voltage EXVcc attaining a prescribed potential level or more, the internal power supply voltage INVcc hardly changes to maintain a constant value (reference voltage Vref level). Accordingly, with the use of MOS transistor NT4 receiving the internal power supply voltage INVcc at its gate for the current source, the external power supply voltage EXVcc dependency of current I output from this constant current generating circuit can be reduced significantly. When the external power supply voltage EXVcc varies, a gate-source voltage of MOS transistors PT1 and PT2 changes similarly to offset the variation in external power supply voltage EXVcc, so that constant current having extremely small external power supply voltage EXVcc dependency (having only internal power supply voltage INVcc dependency) can be produced.

Figure 6:
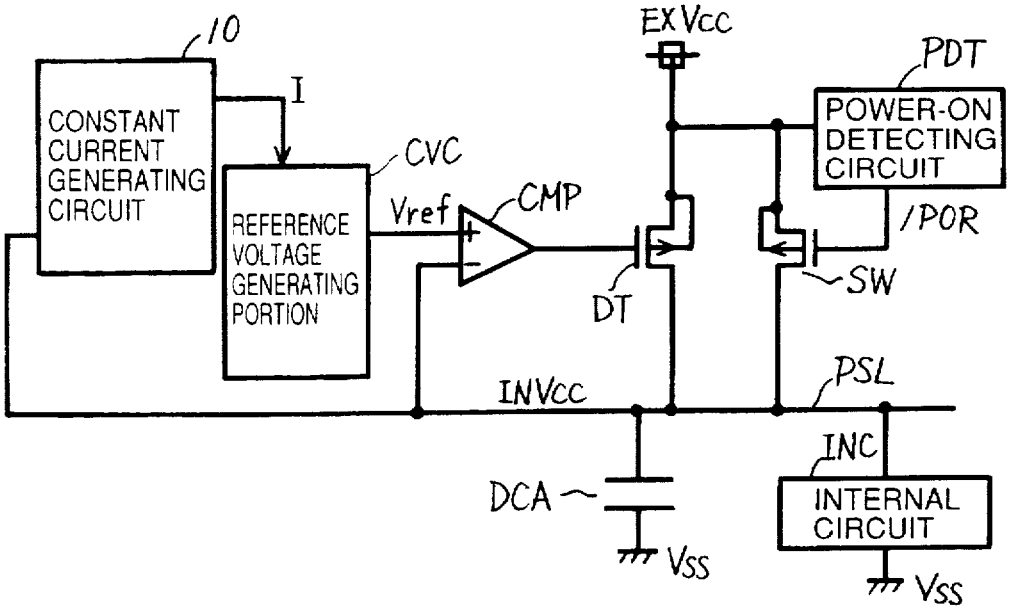
FIG. 6 schematically shows the structure of an internal power supply voltage generating portion using a constant current generating circuit according to the present invention.

FIG. 6 schematically shows the structure of an internal power supply voltage generating portion where the constant current generating circuit shown in FIG. 4 is used. The internal power supply voltage generating portion shown in FIG. 6 includes a reference voltage generating portion CVC for converting constant current I from constant current generating circuit 10 into voltage to generate a reference voltage Vref, a comparator CMP for comparing the internal power supply voltage INVcc on an internal power supply line PSL with the reference voltage Vref, and a driver transistor DT responsive to an output signal of comparator CMP for supplying current from an external power supply node EXVcc to internal power supply line PSL.

Constant current generating circuit 10 is the same as that shown in FIG. 4. Constant current generating circuit 10 therefore receives the internal power supply voltage INVcc on internal power supply line PSL at current source 1 included therein to generate current. When constant current generating circuit 10 shown in FIG. 4 is used, the reference voltage Vref is generated according to constant current I from constant current generating circuit 10, driver transistor DT is driven in response to the output signal of comparator CMP, and the internal power supply voltage INVcc is adjusted in level and transmitted to constant current generating circuit 10. Accordingly, constant current generating circuit 10, reference voltage generating portion CVC, comparator CMP, driver transistor DT and internal power supply line PSL form one feedback loop. However, decoupling capacitance DCA for stabilization of the internal power supply voltage INVcc and a ground voltage Vss is provided for internal power supply line PSL. Therefore, in this feedback loop, noise is absorbed by the decoupling capacitance DCA, whereby the possibility of oscillation or vibration of the feedback loop is extremely low.

An internal circuit INC performs a prescribed operation with the internal power supply voltage INVcc on internal power supply line PSL. When the internal power supply voltage INVcc is reduced in level during operation of the internal circuit INC, conductance of driver transistor DT is increased, whereby current is supplied from external power supply node EXVcc to internal power supply line PSL. This change in internal power supply voltage INVcc is rapid and sufficiently faster than that in characteristic frequency of the above-mentioned feedback loop, and therefore, vibration of the feedback loop in response to the rapid change in internal power supply voltage INVcc is suppressed.

This internal power supply voltage generating portion further includes a power-on detecting circuit PDT for detecting application (power-on) of the external power supply voltage EXVcc, and a switching transistor SW constituted by a p channel MOS transistor turned on in response to a power-on detection signal /POR from power-on detecting circuit PDT for electrically connecting external power supply node EXVcc with internal power supply line PSL. This power-on detecting circuit PDT activates the power-on detection signal /POR at an L level for a prescribed period when the external power supply voltage EXVcc is applied and attains a prescribed power supply voltage level or higher. Thus, switching transistor SW is rendered conductive to electrically connect external power supply node EXVcc with internal power supply line PSL, and the internal power supply voltage INVcc rises with the external power supply voltage EXVcc. Thus, switching transistor SW is turned on by this power supply-on detection signal /POR, whereby the internal power supply voltage INVcc is increased with the external power supply voltage EXVcc after power-on and can be applied to a control electrode node (gate) of a current source MOS transistor NT4 in constant current generating circuit 10, achieving immediate operation of constant current generating circuit 10 after application of the external power supply voltage EXVcc.

When the power-on detection signal /POR attains an H level, switching transistor SW is turned off and constant current generating circuit 10 generates constant current I according to the internal power supply voltage INVcc. The switching of the internal power supply voltage INVcc applied to constant current generating circuit 10 from the external power supply voltage EXVcc resides in the region shown by a sloped straight line in the range of the low external power supply voltage EXVcc in FIG. 5, and constant current generating circuit 10 generates approximately constant current I when the internal power supply voltage INVcc attains a prescribed voltage level or higher (current I2 has extremely small bias voltage VB dependency as indicated in the previous equation).

As described above, according to the second embodiment, the constant current generating circuit is structured such that the internal power supply voltage INVcc is applied to the gate of the current source MOS transistor in the constant current generating circuit, whereby constant current having extremely small external power supply voltage dependency can be generated.

[Third Embodiment]

Figure 7:
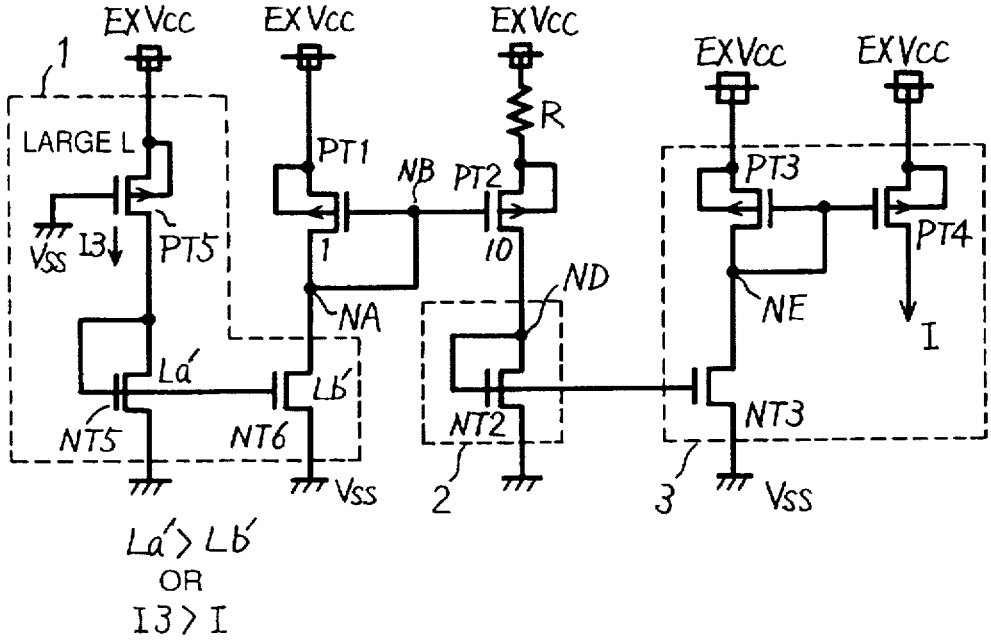
FIG. 7 shows the structure of a constant current generating circuit according to a third embodiment of the present invention.

FIG. 7 shows the structure of a constant current generating circuit according to a third embodiment of the present invention. In the constant current generating circuit shown in FIG. 7, a current source 1 includes a p channel MOS transistor PT5 having its source connected to an external power supply node EXVcc and its gate connected to a ground node Vss, an n channel MOS transistor NT5 connected between the drain of MOS transistor PT5 and ground node Vss and having its gate connected to the drain of MOS transistor PT5, and an n channel MOS transistor NT6 connected between an internal node NA and ground node Vss and having its gate connected to the gate and drain of MOS transistor NT5.

MOS transistor PT5 has a sufficiently increased channel length L and a large resistance value, and a gate/drain voltage of MOS transistor NT5 is made at approximately the same voltage level as that of the threshold voltage of MOS transistor NT5, whereby the external power supply voltage EXVcc dependency of the gate/drain voltage of MOS transistor NT5 is sufficiently reduced. MOS transistor NT5 and NT6 constitute a current mirror circuit and mirror current of current flowing through MOS transistor NT5 flows through MOS transistor NT6. Accordingly, the external power supply voltage EXVcc dependency of the current flowing through MOS transistor NT6 can be reduced extremely, whereby the external power supply voltage EXVcc dependency of a potential at node NB is reduced sufficiently.

The potential at internal node NB determines the amount of current flowing through MOS transistor PT2 and therefore determines a value of current I, and further determines a voltage level of the reference voltage Vref. Since the internal power supply voltage INVcc is adjusted according to the reference voltage Vref, the external power supply voltage EXVcc dependency of the internal power supply voltage INVcc can be extremely reduced by extreme reduction in external power supply voltage EXVcc dependency of the potential at internal node NB.

Current I3 flowing through MOS transistor PT5 ideally has a magnitude which is about the same as that of reference current I output from a voltage/current converting portion 3 (in order to suppress increase in current consumption). When MOS transistors NT5 and NT6 are located physically adjacent to each other, variation in a manufacturing parameter occurs in these MOS transistors NT5 and NT6 in the same direction and therefore variation in device characteristics is offset, whereby current having the same magnitude as that of current I3 can be supplied through MOS transistor NT6.

However, the characteristics of MOS transistors NT5 and NT6 might be varied differently by variation in manufacturing parameter. When a conductance coefficient β of MOS transistor NT5 becomes larger than that of MOS transistor NT6, current flowing through MOS transistor NT6 becomes smaller than current I3 and current I is accordingly reduced in magnitude, whereby reference current I having a required magnitude might not be able to be supplied. If there is possibility that the conductance coefficient of MOS transistor NT6 becomes smaller than that of MOS transistor NT5, a channel length La' of MOS transistor NT5 is made larger than a channel length Lb' of MOS transistor NT6 in advance (but those MOS transistors have the same channel width (gate width)). Thus, if the channel length of MOS transistor NT6 becomes larger due to variation in manufacturing parameter, the conductance coefficients β of MOS transistors NT5 and NT6 can be made equal to each other and current of approximately the same magnitude as that of current I3 can be applied through MOS transistors PT1 and NT6, whereby reference current I of a required magnitude can be produced accordingly.

Alternatively, MOS transistor PT5 may be designed to have such a size that a current I3 flowing through MOS transistor PT5 is larger than reference current I. In this case, even when MOS transistors NT5 and NT6 are designed to have the same size (gate width/gate length) and a conductance coefficient β of MOS transistor NT6 becomes smaller than that of MOS transistor NT5 due to variation in manufacturing parameter, current I3 is larger than reference current I and therefore current of required magnitude can be applied through MOS transistors PT1 and NT6, whereby reference current I of required magnitude can be produced.

As described above, according to the third embodiment, current is generated by means of a resistive element of a high resistance, a reference potential is generated by the diode-connected MOS transistor receiving the current, and a gate potential of the current source transistor connected between internal node NA and the ground node is adjusted by the reference potential, whereby the external power supply voltage EXVcc dependency of the gate potential can be extremely reduced and therefore constant current I having extremely small external power supply voltage EXVcc dependency can be generated. In addition, appropriate adjustment of current flowing through the resistive load element or of gate lengths of the diode-connected MOS transistor and the current source transistor allows current flowing through the current source transistor and the diode-connected MOS transistor to have approximately the same magnitude even with variation in manufacturing parameter caused, and therefore, reference current of required magnitude can be produced even with a manufacturing parameter varied, resulting in implementation of a stable constant current generating circuit.

[Fourth Embodiment]

Figure 8:
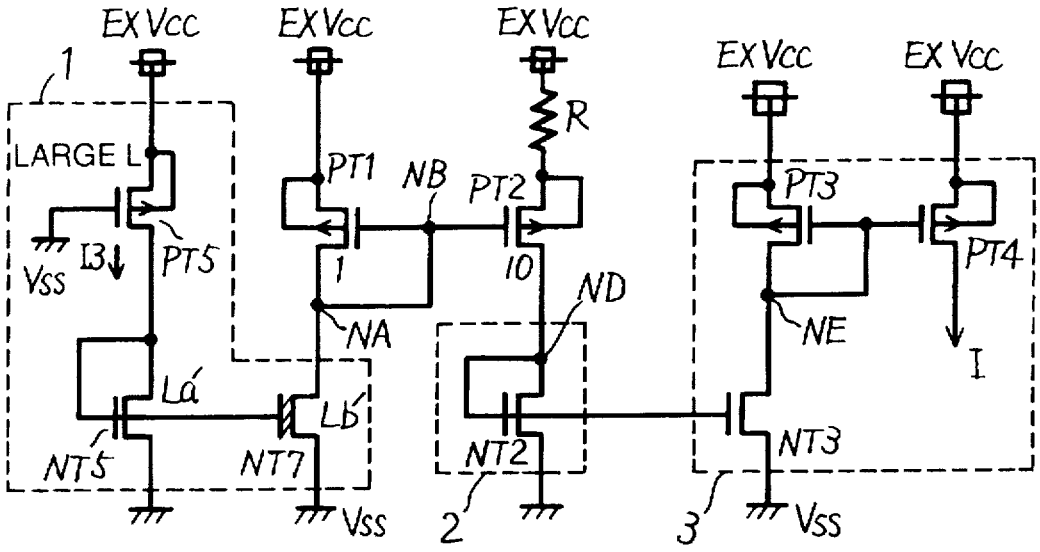
FIG. 8 shows the structure of a constant current generating circuit according to a fourth embodiment of the present invention.

FIG. 8 shows the structure of a constant current generating circuit according to a fourth embodiment of the present invention. In the structure shown in FIG. 8, an MOS transistor NT7 having a low threshold voltage (hereinafter referred to as a low Vth transistor) is used as a current source transistor connected between an internal node NA and a ground node Vss in a current source 1. The structure of FIG. 8 is otherwise the same as that shown in FIG. 7, and corresponding portions are denoted with the same reference numerals or characters.

Figure 9:
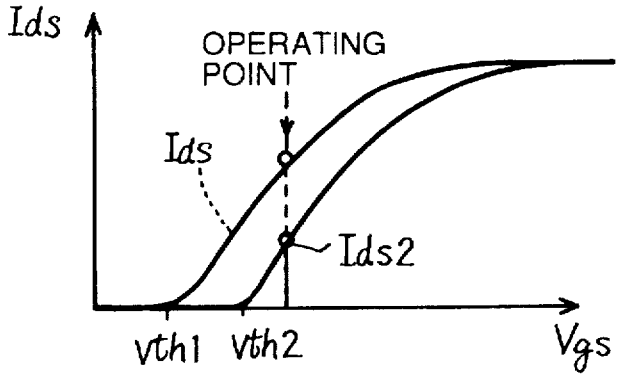
FIG. 9 is a diagram for use in illustration of the operation of the constant current generating circuit shown in FIG. 8.

As can be seen from the relation between a gate voltage Vgs and drain current Ids shown in FIG. 9, the amount of current flowing in a linear region of an MOS transistor having a low threshold voltage Vth is larger than that flowing in a linear region of another MOS transistor having a normal threshold voltage. In FIG. 9, drain current Ids1 of an MOS transistor having a threshold voltage Vth1 and drain current Ids2 of an MOS transistor having a threshold voltage Vth2 are shown. When low Vth transistor NT7 has a threshold voltage Vth1 and an MOS transistor NT5 has a threshold voltage Vth2, respective operating points thereof are set in the linear regions, and therefore, current flowing through low Vth transistor NT7 is larger than that flowing through MOS transistor NT5.

Accordingly, even if a conductance coefficient of MOS transistor NT7 is made smaller than that of MOS transistor NT5 due to variation in manufacturing parameter, current of sufficient magnitude can be applied through MOS transistors PT1 and NT7, and therefore reference current I of required magnitude can be produced. Furthermore, if low Vth transistor NT7 is designed to have a threshold voltage sufficiently lower than that of MOS transistor NT5, the threshold voltage of transistor NT7 can be prevented from being higher than that of MOS transistor NT5 even with threshold voltage of transistor NT7 increased due to variation in manufacturing parameter, whereby current of required magnitude can be applied to MOS transistor PT1 and reference current I of required magnitude can be produced as a result.

As described above, according to the fourth embodiment, the constant current generating circuit is structured such that of an MOS transistor having a low threshold voltage is used for the current source transistor and that a reference voltage is applied to the low threshold voltage MOS transistor, whereby reference current of required magnitude can be produced stably without being affected by variation in manufacturing parameter, and reference current having small external power supply voltage dependency can be produced as in the case of the third embodiment.

[Fifth Embodiment]

Figure 10:
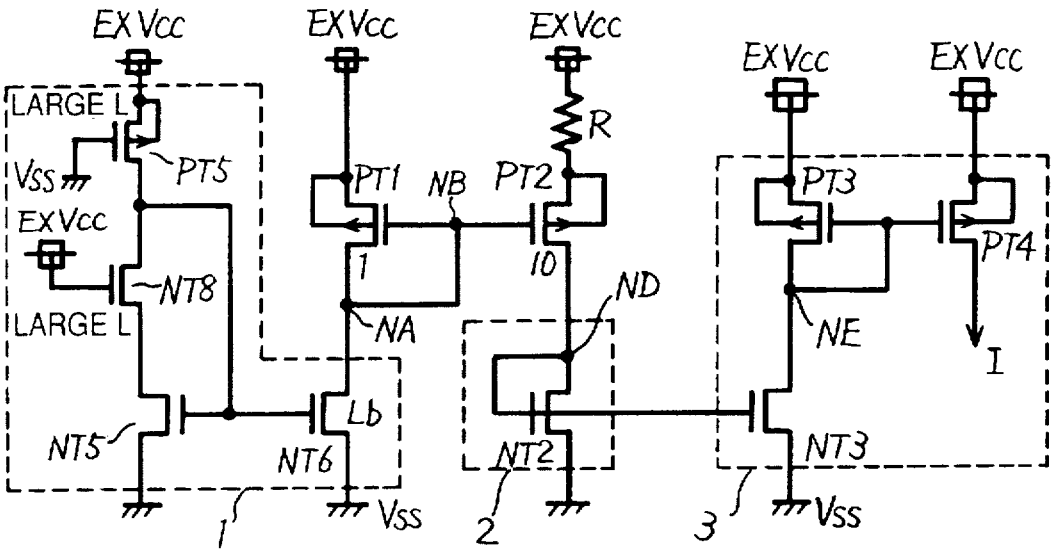
FIG. 10 shows the structure of a constant current generating circuit according to a fifth embodiment of the present invention.

FIG. 10 shows the structure of a constant current generating circuit according to a fifth embodiment of the present invention. The constant current generating circuit shown in FIG. 10 is different from that shown in FIG. 7 in that an n channel MOS transistor NT8 having its gate connected to receive an external power supply voltage EXVcc is additionally provided between an MOS transistor PT5 and an MOS transistor NT5 in a current source 1. The structure of FIG. 10 is otherwise the same as that of the constant current generating circuit shown in FIG. 7, and corresponding portions are denoted with the same reference numerals or characters. The gates of MOS transistors NT5 and NT6 are connected to the drain of MOS transistor PT5.

The gate-source potential difference of MOS transistor PT5 is increased and channel resistance thereof is reduced with increase in external power supply voltage EXVcc, while the gate-source potential difference thereof is reduced and the channel resistance thereof is increased with reduction in external power supply voltage EXVcc. With increase in external power supply voltage EXVcc, current flowing through MOS transistor PT5 is increased, and a drain potential thereof is reduced. Accordingly, a gate potential of MOS transistor NT5 is reduced, the amount of supplying current of MOS transistor NT5 is reduced, a source potential of MOS transistor NT8 is increased in level, and the gate-source potential difference of MOS transistor NT8 is reduced, whereby the amount of current supplied from MOS transistor PT5 is reduced and the drain potential (the gate potential of MOS transistor NT5) of MOS transistor PT5 is increased in level.

Meanwhile, with reduction in external power supply voltage EXVcc, the gate-source potential difference of MOS transistor PT5 is reduced, the amount of current supplied through MOS transistor PT5 is reduced, and the drain potential of MOS transistor PT5, that is, the gate potential of MOS transistor NT5 is increased. As a result, current flowing through MOS transistor NT5 is increased, the source potential of MOS transistor NTB is reduced in level, the gate-source potential difference of MOS transistor NT8 is increased, whereby large current is supplied and therefore the drain potential of MOS transistor PT5, that is, the gate potential of MOS transistor NT5 is reduced in level. Thus, the external power supply voltage EXVcc dependency of the gate potential of MOS transistor NT5 is reduced, and therefore, current having extremely small external power supply voltage EXVcc dependency can be applied to MOS transistors PT1 and NT6, whereby the external power supply voltage EXVcc dependency of reference current I can be reduced.

As described above, according to the fifth embodiment, MOS transistor NT8 having its gate receiving the external power supply voltage EXVcc is connected between MOS transistor PT5 serving as a load resistive element and MOS transistor NT5 for reference potential generation in a reference potential generating portion of the current source, whereby the external power supply voltage EXVcc dependency of the gate potential of MOS transistor NT5 can be extremely reduced, whereby reference current I having extremely small external power supply voltage EXVcc dependency can be produced and an internal power supply voltage INVcc having extremely small external power supply voltage EXVcc dependency can be produced as a result.

[Sixth Embodiment]

Figure 11:
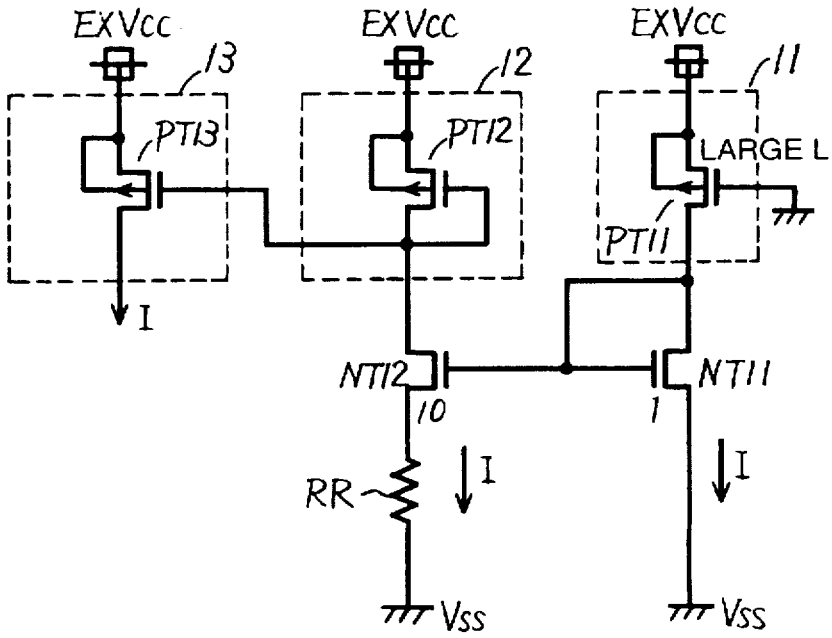
FIG. 11 shows the structure of a constant current generating circuit according to a sixth embodiment of the present invention.

FIG. 11 shows the structure of a constant current generating circuit according to a sixth embodiment of the present invention. In FIG. 11, a current source 11, a current/voltage converting element 12 and a voltage/current converting portion 13 are connected to an external power supply node EXVcc. An n channel MOS transistor NT11 having its gate and drain connected to each other is connected between current source 11 and a ground node Vss, and an MOS transistor NT12 and a resistive element RR are connected in series between current/voltage converting element 12 and ground node Vss. MOS transistor NT12 has its gate connected to the gate of MOS transistor NT11. A conductance coefficient (or the ratio of gate width to gate length) of MOS transistor NT12 is set to be about ten times that of MOS transistor NT11.

Current source 11 includes a p channel MOS transistor PT11 connected between the external power supply node and MOS transistor NT11 and having its gate connected to the ground node. MOS transistor PT11 has a sufficiently increased channel length, and functions as a resistive load element of a high resistance to determine an amount of current flowing into MOS transistor NT11.

Current/voltage converting element 12 includes a p channel MOS transistor PT12 connected between external power supply node EXVcc and MOS transistor NT12 and having its gate and drain connected to each other.

Voltage/current converting portion 13 includes a p channel MOS transistor PT13 having its one conduction node (source) connected to external power supply node EXVcc and its gate connected to the gate and the drain of MOS transistor PT12. Reference current I is output from the drain of MOS transistor PT13.

The constant current generating circuit shown in FIG. 11 is structured such that a polarity of power supply voltage and a conductivity type of an MOS transistor are substantially opposite to those of the constant current generating circuit shown in FIG. 2. Also in the constant current generating circuit shown in FIG. 11, the difference in source potential between MOS transistors NT12 and NT11 is produced by the difference in conductance coefficient (or ratio of gate width to gate length) between MOS transistors NT11 and NT12, and the produced difference is converted into current I by resistive element RR. Accordingly, current of the same magnitude as that of current described above in connected with FIG. 3 is supplied.

MOS transistors PT12 and PT13 constitute a current mirror circuit. Accordingly, if MOS transistors PT12 and PT13 has the same size (ratio of gate width to gate length), current of the same magnitude as that of current flowing through MOS transistor PT12 is output as reference current I. An amount of current flowing through MOS transistor PT12 is determined by MOS transistor NT12. Therefore, reference current I having small external power supply voltage EXVcc dependency can be produced in a manner similar to that in the case of the constant current generating circuit shown in FIG. 2.

Furthermore, due to the positive temperature characteristics of resistive element RR, the source potential of MOS transistor NT12 is increased and current I is reduced with increase in temperature. More specifically, this reference current I has negative temperature characteristics. Accordingly, with the use of the circuit CVC shown in FIG. 19 as a reference voltage generating circuit, positive temperature characteristics of channel resistance of the reference voltage generating portion can be compensated for and a reference voltage Vref having less positive temperature characteristics can be generated.

In the constant current generating circuit shown in FIG. 11, voltage/current converting portion 13 is constituted only by MOS transistor PT13, achieving reduction in circuit occupying area.

In addition, also in the structure shown in FIG. 11, the gates of MOS transistors PT12 and PT11 are isolated from each other to form an "open loop type" constant current generating circuit without feedback loop, and oscillation or the like is not produced, whereby reference current at a desired level can be produced stably.

Current source 11 is constituted by a single MOS transistor PT11 which has its gate coupled to receive a ground potential, and this MOS transistor PT11 is immediately rendered conductive with increase in external power supply voltage EXVcc to a prescribed level or higher to supply current all the time, whereby no start-up circuit is required, achieving reduction in circuit occupying area.

[Seventh Embodiment]

Figure 12:
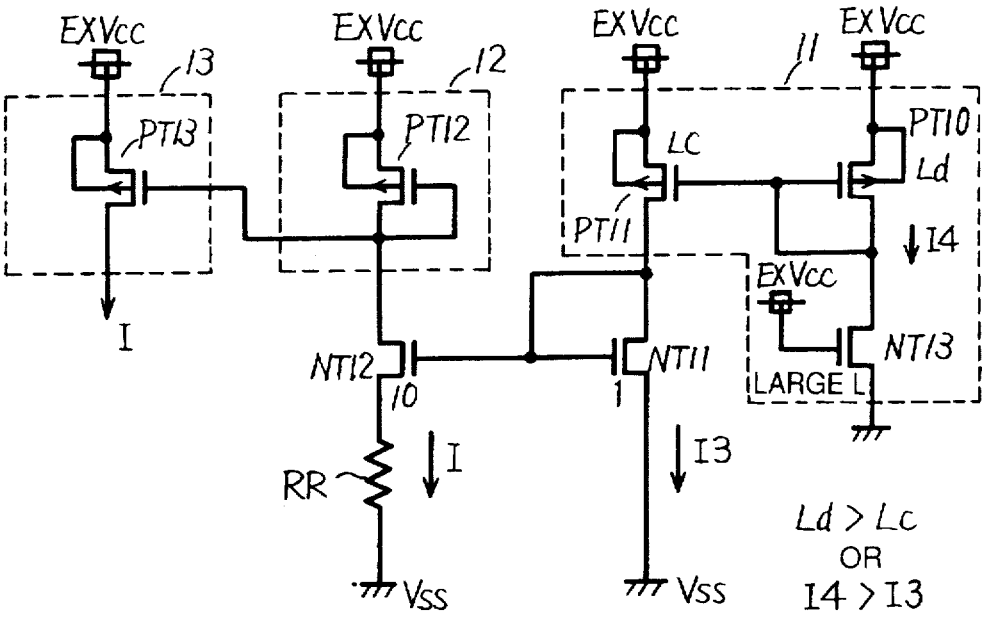
FIG. 12 shows the structure of a constant current generating circuit according to a seventh embodiment of the present invention.

FIG. 12 shows the structure of a constant current generating circuit according to a seventh embodiment of the present invention. The constant current generating circuit shown in FIG. 12 is different from that shown in FIG. 11 in structure of current source 11. The constant current generating circuit shown in FIG. 12 is otherwise the same as that shown in FIG. 11, and corresponding portions are denoted with the same reference numerals or characters and detailed description thereof will not be repeated herein.

In FIG. 12, current source 11 includes a p channel MOS transistor PT10 having its one conduction node (source) connected to an external power supply node EXVcc and its gate and another conduction node (drain) connected to each other, an n channel MOS transistor NT13 connected between a ground node Vss and the gate/drain of MOS transistor PT10 and having its gate connected to receive external power supply voltage EXVcc, and a p channel MOS transistor PT11 connected between external power supply node EXVcc and an MOS transistor NT11 and having its gate connected to the gate/drain of MOS transistor PT10.

In the structure of current source 11, MOS transistor NT13 has a large channel length L, functions as a resistive load element of a high resistance, and supplies constant current according to external power supply voltage EXVcc. When MOS transistor NT13 is turned on, current I4 flows from external power supply node EXVcc into ground node Vss, and a gate potential of MOS transistor PT10 is determined according to this current I4. The gate potential of MOS transistor PT10 is approximated to EXVcc −|Vthp|−I4·Rc, where Rc indicates channel resistance of MOS transistor PT10 and Vthp indicates a threshold voltage of MOS transistor PT12. A magnitude of current I4 is determined by a conductance coefficient of MOS transistor NT12, external power supply voltage EXVcc, and a threshold voltage of MOS transistor NT10.

When MOS transistors PT11 and PT10 have approximately the same size (the same conductance coefficient β), current I4 flows through MOS transistor PT11. MOS transistor PT11 and PT10 constitute a current mirror circuit, and variation in external power supply voltage EXVcc, if any, appears in common in MOS transistors PT11 and PT10, and therefore, this variation in external power supply voltage EXVcc is offset, whereby current being extremely less susceptible to the variation in external power supply voltage EXVcc flows through MOS transistor PT10. Thus, current I flowing through MOS transistors PT10 and NT12 can be reduced in external power supply voltage EXVcc dependency, and therefore reference current I can be reduced in the external power supply voltage EXVcc dependency.

MOS transistors PT11 and PT10 are formed close to each other. However, MOS transistors PT11 and PT10 might have different device characteristics due to variation in manufacturing parameter. In this case, measures similar to those in the case of the structure shown in FIG. 7 are applied. More specifically, a gate length Ld of MOS transistor PT12 is made longer than a gate length Lc of MOS transistor PT10. A conductance coefficient of MOS transistor PT10 is made smaller than that of MOS transistor PT11. Even if the gate length of MOS transistor PT11 is increased and the conductance coefficient thereof is reduced due to variation in manufacturing parameter, it only causes the conductance coefficient of MOS transistor PT11 to be closer to that of MOS transistor PT10, and current I3 of approximately the same magnitude as that of current I4 can be supplied. Thus, even with manufacturing parameter varied, reference current of required magnitude can be supplied and therefore a reference voltage Vref at a required voltage level can be produced.

Alternatively, the structure of FIG. 12 is designed such that a value of current I4 is larger than that of current I3, as in the case of the structure shown in FIG. 7. Since current I4 is designed to have a large value, current I3 of required magnitude can be supplied even with manufacturing parameter varied and even with conductance coefficient of MOS transistor PT11 reduced (note that MOS transistors PT11 and PT10 are designed to have the same conductance coefficient in this case).

Accordingly, effects similar to those of the third embodiment shown in FIG. 7 can also be obtained by the structure of the constant current generating circuit according to the seventh embodiment shown in FIG. 12, and reference current with small external power supply voltage dependency, that is, reference voltage therewith can be produced.

[Eighth Embodiment]

Figure 13:
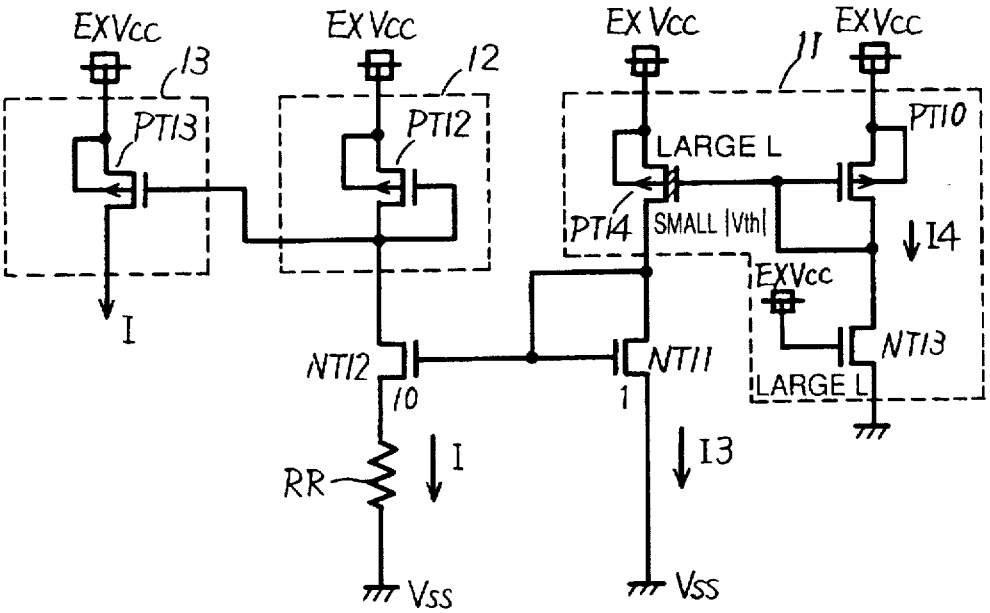
FIG. 13 shows the structure of a constant current generating circuit according to an eighth embodiment of the present invention.

FIG. 13 shows the structure of a constant current generating circuit according to an eighth embodiment of the present invention. The constant current generating circuit shown in FIG. 13 is different in structure from that shown in FIG. 12 only in that a p channel MOS transistor PT14 having a small absolute value of a threshold voltage is connected between an external power supply node EXVcc and an MOS transistor NT11 in a current source 11. Corresponding portions are denoted with the same reference numerals or characters, and detailed description thereof will not be repeated herein.

MOS transistor PT14 is made to have a relatively large gate length. A gate/drain potential of an MOS transistor PT10 has a voltage level close to EXVcc less an absolute value of a threshold voltage thereof. Since the absolute value of the threshold voltage of MOS transistor PT14 is preset to be sufficiently small, MOS transistor PT14 is surely turned on even with the absolute value of the threshold voltage of MOS transistor PT14 being increased due to variation in manufacturing parameter, whereby current can be supplied from external power supply node EXVcc into MOS transistor NT11.

If an absolute value of a threshold voltage is small, relatively large current flows in a linear region thereof, as described in connection with an n channel MOS transistor with reference to FIG. 10. This large current is suppressed by increase in the gate length L to a relatively large value to supply current I3 of approximately the same magnitude as that of current I4 (a conductance coefficient βof MOS transistor PT14 is reduced a little). Thus, current can be surely supplied from current source 11 to MOS transistor NT11 even with manufacturing parameter or the like varied, and MOS transistor PT14 is turned on at a relatively quick timing after application of an external power supply voltage EXVcc (MOS transistor PT14 can be turned on before turning-on of MOS transistor PT10), whereby reference current I can be produced quickly and stably.

[Ninth Embodiment]

Figure 14:
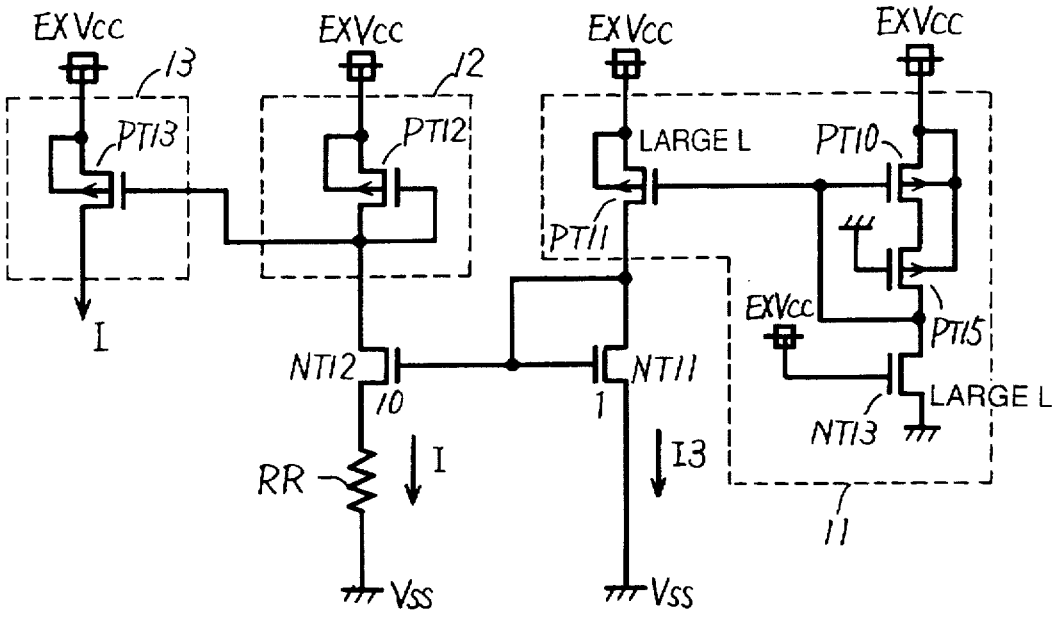
FIG. 14 shows the structure of a constant current generating circuit according to a ninth embodiment of the present invention.

FIG. 14 shows the structure of a constant current generating circuit according to a ninth embodiment of the present invention. The constant current generating circuit shown in FIG. 14 is different from that shown in FIG. 12 in structure of current source 11. Current source 11 shown in FIG. 14 is different in structure from that shown in FIG. 12 in that a p channel MOS transistor PT15 having its gate connected to receive a ground voltage Vss is additionally provided between MOS transistor PT10 and MOS transistor NT13.

MOS transistor NT13 has its driving current increased with increase in voltage level of an external power supply voltage EXVcc, lowering a gate potential of MOS transistor PT10. When the gate potential of MOS transistor PT10 is reduced, current flowing through MOS transistor PT10 is increased and the source potential of MOS transistor PT15 is raised. Accordingly, the gate-source potential difference of MOS transistor PT15 is enlarged, and MOS transistor PT15 supplies large current to MOS transistor NT13, suppressing reduction in gate potential of MOS transistor PT10.

Meanwhile, MOS transistor NT13 has its driving current reduced with reduction in external power supply voltage EXVcc. The gate potential of MOS transistor PT10 is increased in response to the reduction in current, the gate-source potential difference of MOS transistor PT10 is accordingly reduced, and the driving current is reduced as a result.

Accordingly, the gate-source potential difference of MOS transistor PT15 is reduced, the amount of current applied from MOS transistor PT15 to MOS transistor NT13 is reduced, suppressing increase in gate potential of MOS transistor PT10. Thus, the external power supply voltage EXVcc dependency of respective gate potentials of MOS transistors PT10 and PT11 is significantly reduced, and the external power supply voltage EXVcc dependency of current I3 flowing through MOS transistor PT11 is also significantly reduced. Accordingly, the external power supply voltage EXVcc dependency of reference current I output from a voltage/current converting portion 13 is significantly reduced.

As described above, according to the ninth embodiment, p channel MOS transistor PT15 receiving a ground potential at its gate is connected between MOS transistor PT10 and load MOS transistor NT13 serving as a current source in current source 11, whereby the external power supply voltage EXVcc dependency of gate potential of MOS transistor PT10 is significantly reduced, and stable reference current I can be produced.

[Tenth Embodiment]

Figure 15:
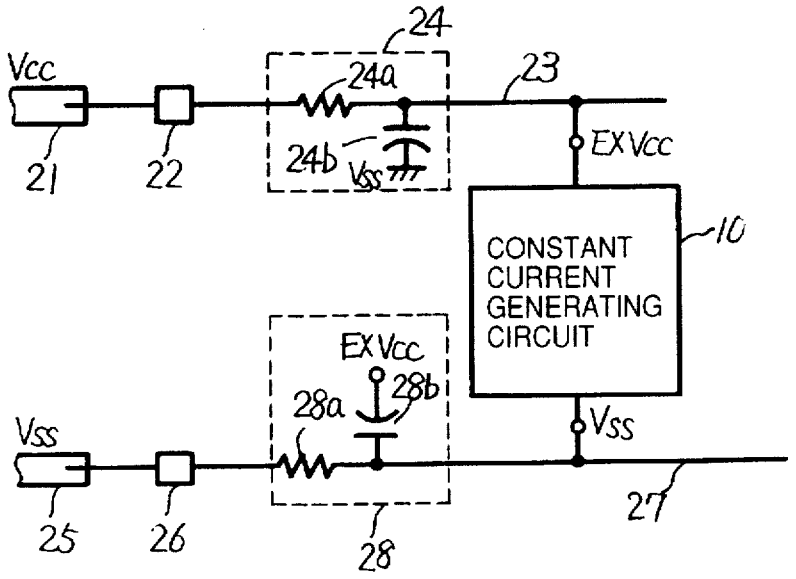
FIG. 15 shows the structure of a constant current generating circuit according to a tenth embodiment of the present invention.

FIG. 15 shows the structure of a constant current generating circuit according to a tenth embodiment of the present invention. In FIG. 15, constant current generating circuit 10 is electrically connected to an external power supply line 23 through an external power supply node EXVcc, and is connected to a ground line 27 through a ground node Vss. External power supply line 23 is connected to a power supply pad 22 through a low pass filter 24. This power supply pad 22 is connected to a lead terminal 21 receiving an external power supply voltage Vcc through a bonding wire. Low pass filter 24 includes a resistive element 24*a* inserted in external power supply line 23, and capacitance 24*b* connected between external power supply line 23 and ground node Vss.

Ground line 27 is connected to a ground pad 26 through a low pass filter 28. This ground pad 26 is connected to a lead terminal 25 receiving an external ground voltage Vss through a bonding wire. Low pass filter 28 includes a resistive element 28*a* inserted in ground line 27, and capacitance 28*b* connected between ground line 27 and external power supply node EXVcc. Capacitance 24*b* and capacitance 28*b* are constituted by an MOS capacitor for example, to reduce occupying area of capacitance. A cut off frequency fc of low pass filters 24 and 28 is given by $1/(2\cdot\pi R\cdot C)$, where R indicates a resistance value of resistive element 24*a* or 28*a* and C indicates a capacitance value of capacitance 24*b* or 28*b*.

External power supply line 23 and ground line 27 are respectively coupled to external lead terminals 21 and 25 through low pass filters 24 and 28. Accordingly, even if noise is generated on external power supply voltage EXVcc and external ground voltage Vss, the noise is absorbed by low pass filters 24*a* and 28*a*, a constant voltage level can be retained stably without being affected by the noise in power supply voltage EXVcc on external power supply line 23 and on ground voltage Vss on ground line 27. External power supply node EXVcc and ground node Vss supply both operating power supply voltages for constant current generating circuit 10, and therefore, constant current generating circuit 10 can operate stably with small occupying area and without being affected by the noise in external power supply voltage Vcc and in external ground voltage Vss to produce desired stable reference current I. The constant current generating circuit may have any structure of the first to ninth embodiments.

Note that provision of either one of low pass filters 24 and 28 is also possible.

As described above, according to the tenth embodiment, the low pass filters are respectively provided in the external power supply line and the ground line, whereby stable external power supply voltage EXVcc and ground voltage Vss can be supplied to the constant current generating circuit without being affected by noise and without affecting the layout of the constant current generating circuit, reference voltage at a prescribed level which will not be affected by noise can be produced stably.

[Eleventh Embodiment]

Figure 16:
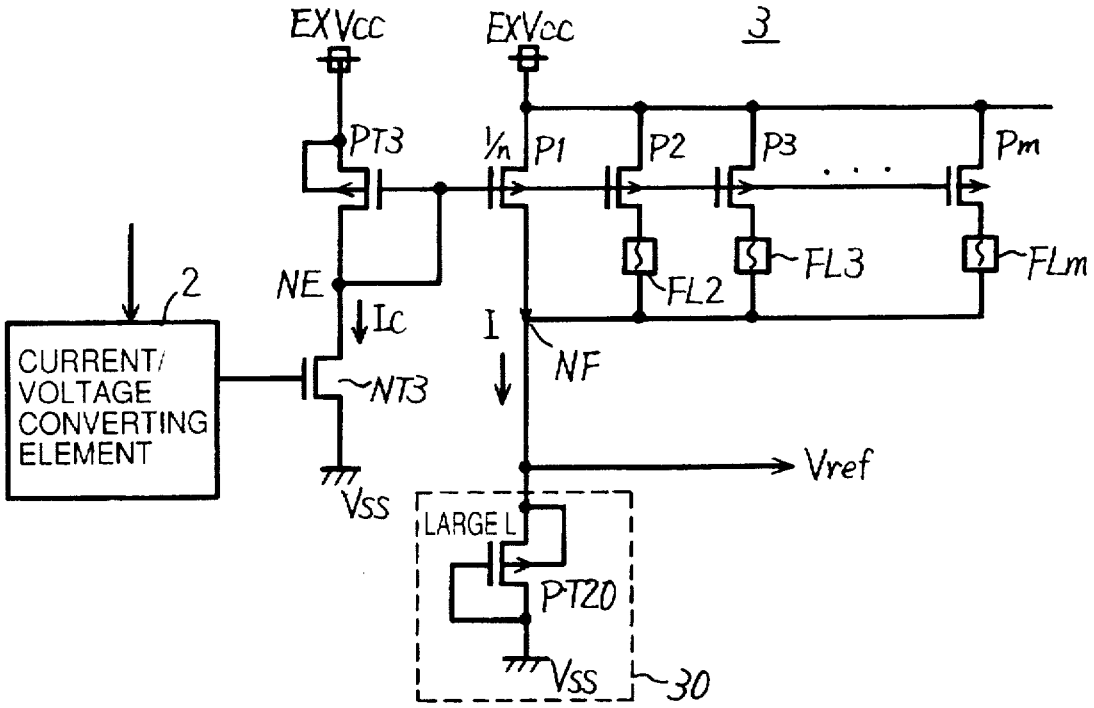
FIG. 16 shows the structure of a constant current generating circuit according to an eleventh embodiment of the present invention.
Figure 17:
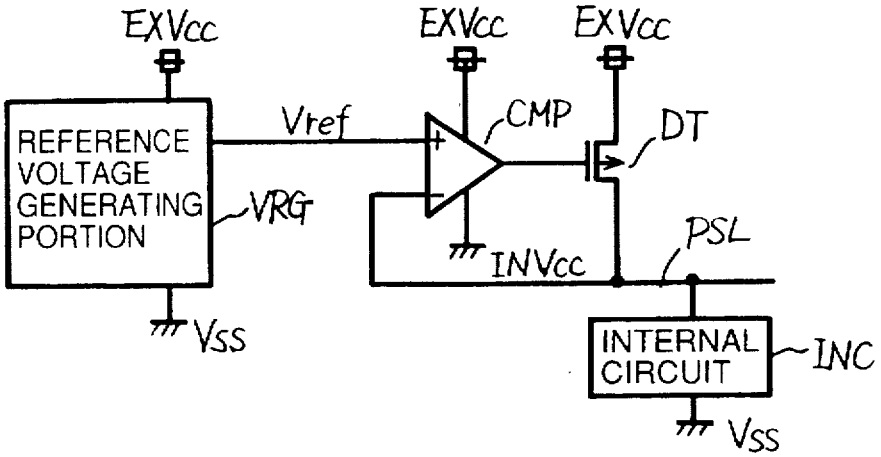
FIG. 17 PRIOR ART
FIG. 17 schematically shows the structure of a conventional internal power supply voltage generating portion.
Figure 18:
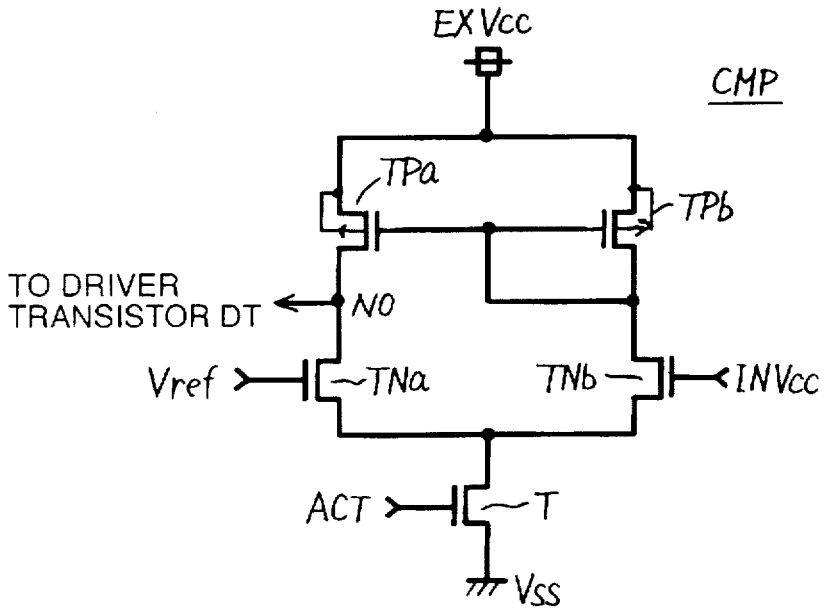
FIG. 18 PRIOR ART
FIG. 18 shows one example of the structure of a comparator shown in FIG. 17.

FIG. 16 shows the structure of a constant current generating circuit according to an eleventh embodiment of the present invention. In FIG. 16, the structure of voltage/current converting portion 3 responsive to voltage information from current/voltage converting element 2 for producing reference current I is shown. In FIG. 16, voltage/current converting portion 3 includes an n channel MOS transistor NT3 connected between a node NE and a ground node Vss and having its gate receiving a voltage produced by current/voltage converting element 2, a p channel MOS transistor PT3 connected between an external power supply node EXVcc and internal node NE and having its gate connected to internal node NE, p channel MOS transistors P1 to Pm coupled in parallel between external power supply node EXVcc and a current output node NF, and fusible link elements FL2 to FLm respectively connected in series with MOS transistors P2 to Pm. A conductance coefficient (or ratio of gate width to gate length) of MOS transistors P1 to Pm is set to be one-nth of that of MOS transistor PT3, where n is an integer which is at least 2. No link element is provided for MOS transistor P1 since MOS transistor P1 is connected between external power supply node EXVcc and current output node NF to supply current.

The gates of MOS transistors P1 to Pm are connected to the gate of MOS transistor PT3. Therefore, MOS transistor PT3 and MOS transistors P1 to Pm constitute a current mirror circuit. A current value of reference current I output from current output node NF can be determined by selective blowing of fusible link elements FL2 to FLm. When all the link elements FL2 to FLm are in a conductive state, all the MOS transistors P1 to Pm supply current from external power supply node EXVcc to current output node NF. Meanwhile, the current value of reference current I can be selectively reduced by selective blowing of fusible link elements FL2 to FLm. Accordingly, the current value of reference current I can be adjusted by the step of Ic/m, whereby Ic indicates current flowing through MOS transistor PT3.

A reference voltage generating portion 30 is constituted by a p channel MOS transistor PT20 receiving reference current I. MOS transistor PT20 has its gate and drain connected to ground node Vss, and operates in a resistance mode. When channel resistance of MOS transistor PT20 is indicated by R20, the reference voltage Vref is given by the following equation.

$$Vref=I\cdot R20+Vth$$

where Vth indicates an absolute value of a threshold voltage of MOS transistor PT20. Selective blowing of fusible link elements FL2 to FLm allows current I to be adjusted by the step of Ic/n. Therefore, reference voltage Vref can be adjusted by the step of Ic·R20/n. MOS transistors P1 to Pm are connected in parallel, having their backgates connected to external power supply node EXVcc while not clearly shown in FIG. 16, and having their gates connected to the gate of MOS transistor PT3. Accordingly, these MOS transistors P1 to Pm have the same backgate bias effect, and therefore, the need for blowing of fusible link elements in consideration of the backgate bias effect of MOS transistors P1 to Pm is eliminated, achieving simple adjustment of reference voltage Vref.

Note that, in the structure shown in FIG. 16, the total sum of gate widths of MOS transistors P1 to Pm may be set to be equal to a gate width of MOS transistor PT3, and the structure in which current I output from reference current output node NF is made larger than current Ic flowing through MOS transistor PT3 by increase in number of MOS transistors P1 to Pm may be used.

Note that the structure of voltage/current converting portion 3 shown in FIG. 16 with MOS transistors connected in parallel for adjusting a reference current value may be applied to the structure shown in FIGS. 11 to 14, or may be used in the conventional reference current generating circuit shown in FIG. 19.

As described above, according to the eleventh embodiment, a gate width of each slave stage MOS transistor in the current mirror circuit for producing reference current is made to be one-nth of that of the master stage MOS transistor therein, and a voltage level of reference voltage can be readily adjusted by selective blowing of fusible link elements connected in series with these MOS transistors.

[Other Applications]

The constant current generating circuit according to the present invention is preferably used for reference voltage generation for producing an internal power supply voltage of a DRAM. However, it may be used as a constant current circuit which requires constant reference current in a semiconductor device. The constant current generating circuit of the present invention can be applied even to the structure in which only external power supply voltage is used singly instead of two power supply voltages of external power supply voltage and internal power supply voltage, so long as constant current is required.

As described above, according to the present invention, a current source for supplying current to a current mirror circuit and a current/voltage converting element for converting current from the current mirror circuit into voltage information are separatedly provided in a constant current generating circuit in which MOS transistors constituting the current mirror circuit have different gate widths (conductance coefficients) and the difference between the conductance coefficients is converted into current by a resistive element, no feedback loop is formed and a so-called "open loop type" reference current generating circuit is implemented, whereby both oscillation or vibration resulting from noise in the feedback loop and "the deadlock phenomenon" that current stops flowing in the current mirror circuit can be prevented, achieving implementation of a constant current generating circuit capable of stably supplying current of required magnitude.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A constant current generating circuit, comprising:

a first field effect transistor of a first conductivity type connected between a first power supply voltage supplying a node supplying a first power supply voltage and a first internal node, and having a control electrode node connected to said first internal node;

a resistive element connected between the first power supply voltage supplying node and a second internal node;

a second field effect transistor of the first conductivity type connected between said second internal node and a third internal node and having a control electrode node connected to said control electrode node of said first field effect transistor;

a current source coupled between said first internal node and a second power supply voltage supplying node supplying a second power supply voltage for causing a prescribed current flow in said first field effect transistor;

a current/voltage converting element isolated from said current source and coupled between said third internal node and a second power supply voltage receiving node receiving said second power supply voltage for producing at said third internal node a voltage according to current flowing through said second field effect transistor; and voltage/current converting means for converting the voltage produced by said current/voltage converting element into current for output.

2. The constant current generating circuit as recited in claim 1, wherein said current source includes a field effect transistor of a second conductivity type connected between said first internal node and the second power supply voltage supplying node and receiving said first power supply voltage at a control electrode node thereof.

3. The constant current generating circuit as recited in claim 1, wherein said current source includes a field effect transistor of a second conductivity type connected between said first internal node and the second power supply voltage receiving node and receiving at a control electrode node thereof an internal power supply voltage produced by down-conversion of a power supply voltage externally applied as said first power supply voltage.

4. The constant current generating circuit as recited in claim 1, wherein said current source includes reference voltage generating means coupled between the first power supply voltage supplying node and the second power supply voltage supplying node for generating a reference voltage independent of said first power supply voltage, and a field effect transistor of a second conductivity type connected between said first internal node and the second power supply voltage supplying node and receiving said reference voltage at a control electrode node thereof.

5. The constant current generating circuit as recited in claim 1, wherein said current source includes a second resistive element having a one end coupled to a node receiving said first power supply voltage, converting element means connected between another end of said second resistive element and the second power supply voltage receiving node for producing a voltage according to current flowing through said second resistive element, and a third field effect transistor coupled between said first internal node and the second power supply voltage receiving node and receiving at a control electrode node thereof the voltage produced by said converting element means.

6. The constant current generating circuit as recited in claim 5, wherein said converting element means includes a fourth field effect transistor of said second conductivity type coupled between the other end of said second resistive element and said second power supply voltage receiving node, and having a control electrode node thereof coupled to the other end of said second resistive element and the control electrode node of said third field effect transistor.

7. The constant current generating circuit as recited in claim 6, wherein a conductance coefficient $\beta$ of said fourth field effect transistor is made smaller than that of said third field effect transistor.

8. The constant current generating circuit as recited in claim 6, wherein said converting element means further includes a third resistive element connected between the other end of said second resistive element and said fourth field effect transistor.

9. The constant current generating circuit as recited in claim 6, wherein an absolute value of a threshold voltage of said fourth field effect transistor is made smaller than that of at least said first to third field effect transistors.

10. The constant current generating circuit as recited in claim 8, wherein said second resistive element includes a fifth field effect transistor of a first conductivity type receiving said second power supply voltage at a control electrode node thereof, and said third resistive element includes a sixth field effect transistor of a second conductivity type receiving said first power supply voltage at a control electrode node thereof.

11. The constant current generating circuit as recited in claim 1, wherein said current/voltage converting element includes a third field effect transistor of a second conductivity type connected between the second power supply voltage receiving node and said fourth internal node and having a control electrode node connected to said fourth internal node, and said voltage/current converting means includes a fourth field effect transistor of a second conductivity type coupled to said third field effect transistor in a current mirror manner, and a current mirror circuit constituted by a field effect transistor of a first conductivity type coupled to a node receiving said first power supply voltage for producing mirror current of current flowing through said fourth field effect transistor.

12. The constant current generating circuit as recited in claim 1, wherein said current/voltage converting element includes a third field effect transistor of said second conductivity type, and said voltage/current converting means includes a fourth field effect transistor of a second conductivity type coupled to said third field effect transistor in a current mirror manner for supplying current from said second power supply voltage receiving node.

13. The constant current generating circuit as recited in claim 1, further comprising:

a low pass filter connected between the first power supply voltage supplying node and a node receiving an externally applied voltage corresponding to said first power supply voltage.

14. The constant current generating circuit as recited in claim 1, further comprising:

a low pass filter connected between second power supply voltage supplying node and a node receiving an externally applied voltage corresponding to said second power supply voltage.

15. The constant current generating circuit as recited in claim 11, wherein said current mirror circuit includes a fourth field effect transistor of a first conductivity type coupled between the first power supply voltage supplying node and said third field effect transistor, and having a control electrode node and one conduction node connected to one conduction node of said third field effect transistor, a plurality of fifth field effect transistors of a first conductivity type coupled in parallel between the first power supply voltage supplying node and a current output node, and having their control electrode nodes coupled to the control electrode node of said fourth field effect transistor, and a fusible link element connected between each of said plurality of fifth field effect transistors and said current output node.

16. The constant current generating circuit as recited in claim 15, wherein a value of a conductance coefficient β of each said fifth field effect transistor is one-nth times that of said fourth field effect transistor, where n is an integer of at least 2.

17. The constant current generating circuit as recited in claim 1, wherein the current produced by said voltage/current converting means is used for generating a reference voltage by a reference voltage generator.

18. The constant current generating circuit as recited in claim 1, wherein the current produced by said voltage/current converting means is used for generating a reference voltage determining a voltage level of an internal operating power supply voltage by a voltage down-converter down-converting an externally applied power supply voltage to produce said internal operating power supply voltage.

19. The constant current generating circuit as recited in claim 1, wherein a conductance coefficient β of said first field effect transistor is smaller than that of said second field effect transistors.

20. A current generator comprising:

a first field effect transistor of a first conductivity type coupled between a first node supplying a first power supply voltage and a second node, and having a gate coupled to said second node;

a current source including a second field effect transistor of a second conductivity type coupled between said second node and a third node supplying a second power supply voltage;

a resistance element coupled between a fourth node supplying the first power supply voltage and a fifth node;

a third field effect transistor of the first conductivity type coupled between said fifth node and a sixth node, and having a gate coupled to said second node;

a fourth field effect transistor of the second conductivity type coupled between said sixth node and a seventh node supplying the second power supply voltage, and having a gate coupled to said sixth node; and a voltage/current converting portion including a fifth field effect transistor of the second conductivity type having a source coupled to a eighth node supplying the second power supply voltage and a gate coupled to said sixth node.

* * * * *